US007279879B2

(12) United States Patent
Ibaraki

(10) Patent No.: US 7,279,879 B2
(45) Date of Patent: Oct. 9, 2007

(54) CURRENT WASTE SUPPRESSING POWER SUPPLY APPARATUS

(75) Inventor: Tooru Ibaraki, Ohsaka-Fu (JP)

(73) Assignee: Ricoh Company, Ltd. (JP)

( * ) Notice: Subject to any disclaimer, the term of this patent is extended or adjusted under 35 U.S.C. 154(b) by 0 days.

(21) Appl. No.: 10/902,847

(22) Filed: Aug. 2, 2004

(65) Prior Publication Data

US 2005/0024034 A1 Feb. 3, 2005

(30) Foreign Application Priority Data

Jul. 31, 2003 (JP) ..... 2003-205002

(51) Int. Cl.
*G05F 1/56* (2006.01)

(52) U.S. Cl. ..... 323/288; 323/282

(58) Field of Classification Search ..... 323/282–288, 323/272, 300, 313, 312; 320/118, 119
See application file for complete search history.

(56) References Cited

U.S. PATENT DOCUMENTS 4,017,789 A * 4/1977 Morris ..... 323/285
4,929,882 A * 5/1990 Szepesi ..... 323/222
6,420,861 B2 * 7/2002 Ochi et al. ..... 323/288
6,424,121 B1 * 7/2002 Khouri et al. ..... 320/128

FOREIGN PATENT DOCUMENTS

JP 2001-69677 3/2001

* cited by examiner

*Primary Examiner*—Rajnikant B. Patel
(74) *Attorney, Agent, or Firm*—Dickstein Shapiro LLP

(57) ABSTRACT

A power supply apparatus supplies power to one of an interior circuit and external instruments. The power supply apparatus includes a voltage regulator that regulates and outputs a constant voltage through an output driver by comparing the power with a regulator reference voltage, and a power supply voltage detecting device that detects a power supply voltage and determines if the power supply voltage is less than a power supply reference voltage based upon the output of the voltage regulator.

7 Claims, 4 Drawing Sheets

CURRENT WASTE SUPPRESSING POWER SUPPLY APPARATUS

CROSS REFERRENCE TO RELATED APPLICATION

This application claims priority under 35 U.S.C. § 119 to Japanese Patent Application No. 2003-205002 filed on Jul. 31, 2003, the entire contents of which are herein incorporating by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights.

FIELD OF THE INVENTION

The present invention relates to power supply circuits that perform voltage regulation and low voltage detection and are suitable for use in mobile instruments and similar devices. More specificially, the present invention relates to a low cost power supply circuit which minimizes current waste by detecting a low voltage of a power supply in a voltage regulator circuit.

DISCUSSION OF THE BACKGROUND ART

It is well known that a mobile instrument can operate with power supplied from a battery. For example, battery voltage is regulated to constant level by a voltage regulator and is supplied to an interior circuit. In order to detect a low voltage of the battery, a low voltage detection circuit is independently provided to monitor battery voltage in order to prevent the voltage regulator and interior circuit from erroneous operations as discussed in Japanese Patent Application Laid Open No. 2001-69677.

FIG. 3 illustrates an exemplary circuit of a background power supply circuit. As shown, the power supply circuit is built in a background mobile instrument and receives power supply from a battery 1. The power supply circuit supplies an output voltage made constant by a voltage regulator, formed from a reference voltage source 2, a plurality of MOS transistors 3 to 8, and a pair of feedback resistances 9 and 10, through a MOS transistor 5 serving as an output driver to the interior circuit 12 as a regulator output.

Among the plurality of MOS transistors 3, 4, 5, 6, 7, and 8 transistors 34, 5 are P type MOS transistors, while transistors 6, 7, 8 are N-type MOS transistors.

Further, in order to avoid an erroneous operation in the interior circuit 12, a low voltage detection circuit 11 detects whether a battery voltage has decreased to a prescribed level, and outputs a control signal (e.g. a system reset) to the interior circuit 12. Thus, in order to compare voltages of the reference voltage source 2 and battery 1, the low voltage detection circuit 11 includes an amplifier for comparison use employing a MOS transistor, for example, as in the above-mentioned voltage regulator.

Further, in the power supply circuit of FIG. 3, when the battery 1 decreases a voltage, the voltage regulator stops operating and comes to an inert condition incapable of outputting a constant voltage. However, even in the inert condition, the voltage regulator continues to consume current.

FIG. 4 illustrates an exemplary circuit of another background power supply circuit. In the power supply circuit of FIG. 4, when the low voltage detection circuit 11 detects that the battery voltage has decreased to a prescribed level, the reference voltage source 2 and the voltage regulator are stopped via inverter 14 and MOS transistors 13 and 15 to suppress current waste.

However, in the power supply circuit illustrated in FIGS. 3 and 4, despite that comparison is necessarily performed with a voltage of the reference voltage source 2, the low voltage detection circuit 11 and voltage regulator are separated, resulting in a large number of circuit parts and increasing the cost of the power supply circuit. In addition, the large number of circuit parts unnecessarily increases power consumption.

SUMMARY OF THE INVENTION

An object of the present invention is to address these problems and provide a power supply apparatus capable of supplying power to one of an interior circuit and external instruments. The power supply apparatus includes a voltage regulator that regulates and outputs a constant voltage through an output driver by comparing the power with a regulator reference voltage, and a power supply voltage detecting device detects a power supply voltage to determine if the power supply voltage is less than a power supply reference voltage based upon the output of the voltage regulator.

In another embodiment, the power supply voltage detecting device includes a buffer having a hysteresis performance that outputs two stable voltage levels to the output driver in accordance with an input voltage, and a comparison amplifier that compares the regulator reference voltage with a feedback voltage obtained by dividing a voltage output from the output driver. In the preferred embodiment, the buffer is provided at an output side of the comparison amplifier to determine whether the power supply voltage is less than the reference voltage using a voltage output from the comparison amplifier. When necessary, the buffer transmits a control signal to one of the interior circuit and external instruments so as to prevent erroneous operations.

In yet another embodiment, a bias voltage of a MOS transistor included in the comparison amplifier is controlled to decreases an amount of current flowing through the comparison amplifier when the determination is positive.

In yet another embodiment, the voltage to be supplied to one of the interior circuit and external instruments is divided by a feedback resistance and fed back to the comparison amplifier as the feedback voltage. In a preferred embodiment, a ratio of the feedback resistance is changeable.

In yet another embodiment, a bias voltage of the output driver is controlled to enable the output driver to supply the power supply voltage to one of the interior circuit and external instruments when the power supply voltage is less than the reference voltage.

In yet another embodiment, a bias voltage of the output driver is controlled to enable the output driver to output substantially the zero volts to one of the interior and external instruments when the determination is positive.

In yet another embodiment, the power supply voltage itself is divided at the feedback resistance ratio and fed back to the comparison use amplifier as the feedback voltage, when the determination is positive.

BRIEF DESCRIPTION OF DRAWINGS

The foregoing and other advantages and features of the invention will become more apparent from the detailed description of exemplary embodiments of the invention given below with reference to the accompanying drawings, in which.

DETAILED DESCRIPTION OF THE PREFERRED EMBODIMENT

Figure 1:
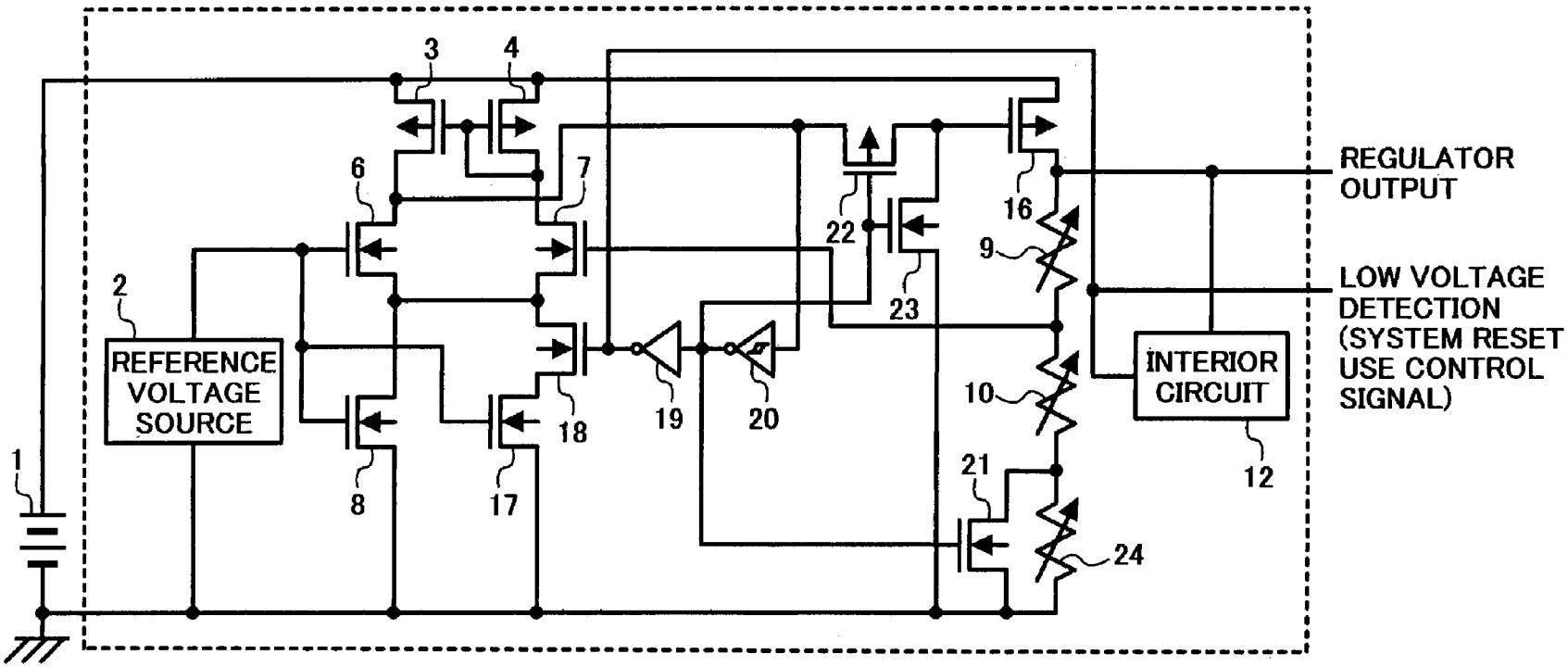
FIG. 1 illustrates an exemplary circuit of a power supply apparatus according to the present invention.
Figure 2:
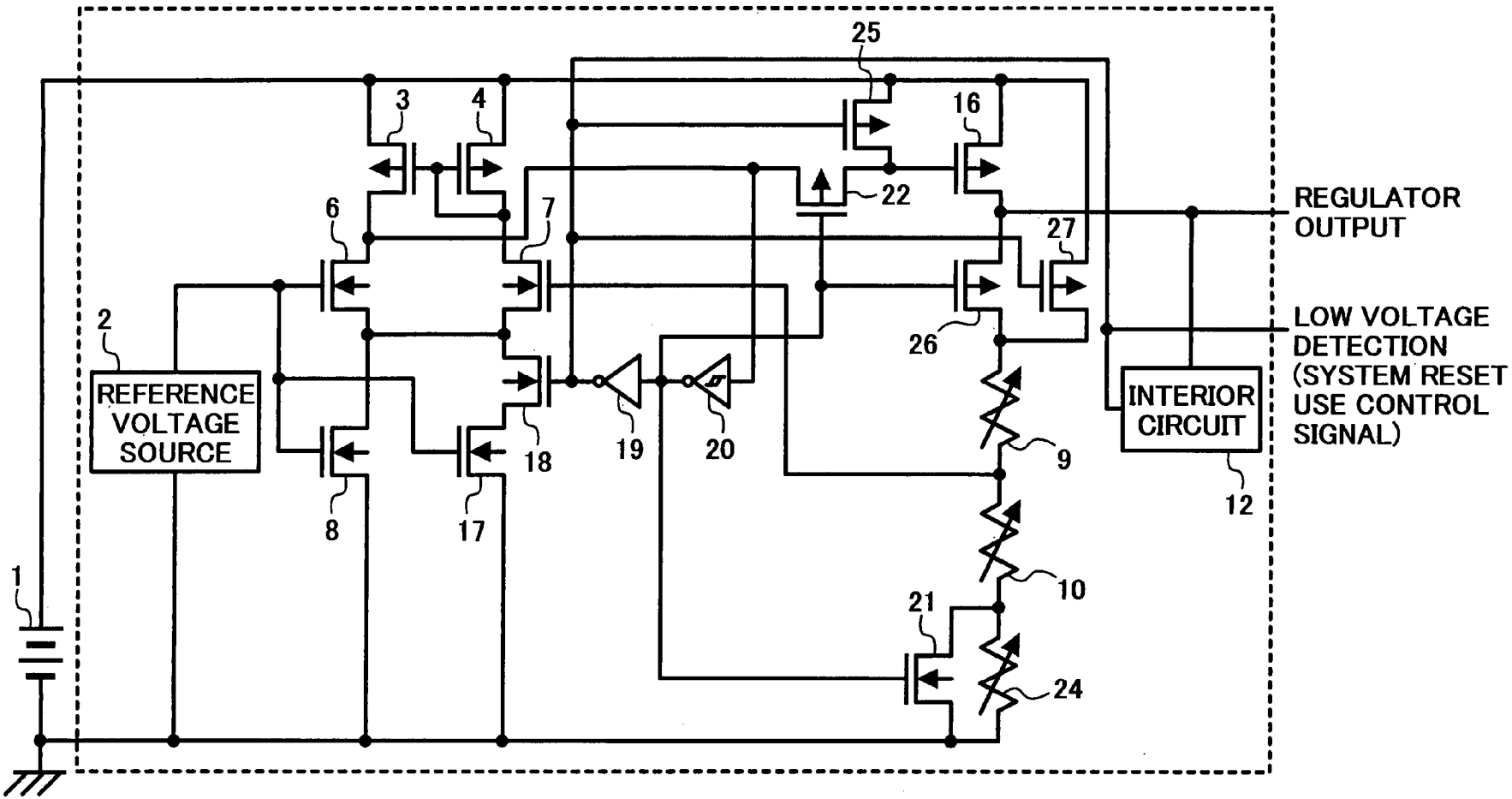
FIG. 2 illustrates an exemplary circuit of a modified power supply apparatus according to the present invention.
Figure 3:
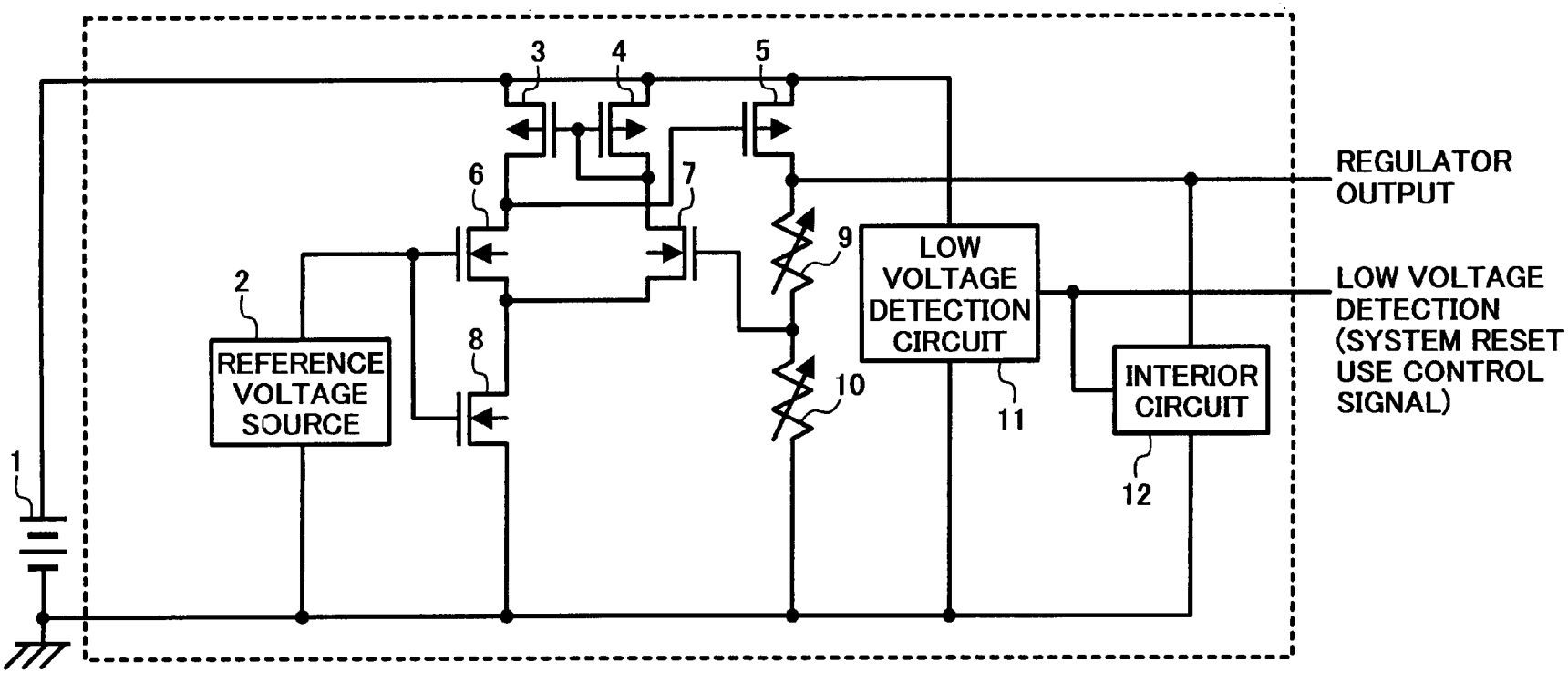
FIG. 3 illustrates a conventional power supply apparatus.
Figure 4:
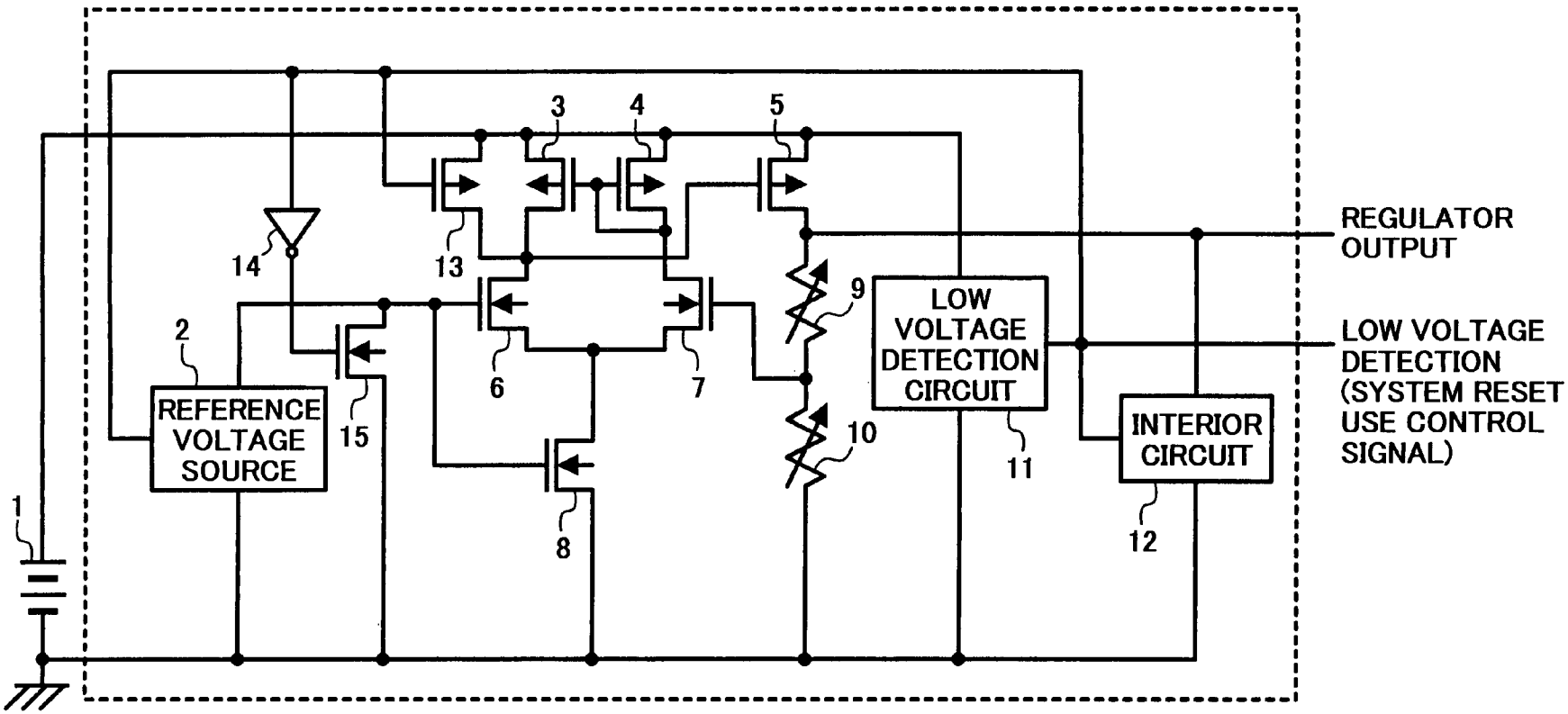
FIG. 4 illustrates another conventional power supply apparatus.

Referring now to the drawing, wherein like reference numerals designate identical or corresponding parts throughout several views, in particular in FIGS. 1 and 2, exemplary embodiments of a power supply apparatus according to the present invention are illustrated. FIG. 1 illustrates a power supply apparatus in which power is supplied to an interior circuit 12 and external instruments even when the voltage of battery 1 decreases to a prescribed level. Specifically, FIG. 1 illustrates one example in which a voltage regulator serves as a low voltage detection circuit due to integration of a low voltage detecting function detecting a low voltage of the battery and a voltage regulation function regulating a voltage of a battery. Similar to background power supply apparatus shown in FIG. 3, the power supply apparatus of FIG. 1 is preferably built in the mobile instrument and supplies power to the interior circuit and so on.

FIG. 2 illustrates an exemplary configuration of a modified circuit of the power supply apparatus of FIG. 1. Power is supplied to neither an interior circuit nor external instruments when the voltage of battery 1 decreases to a prescribed level. A voltage regulator serves as a low voltage detection circuit due to integration of a low voltage detection function detecting a low voltage of a battery 1 and a voltage regulator function regulating a voltage of a battery.

First, the power supply apparatus of FIG. 1 is described in detail. A gate of a MOS transistor 16 used as an output driver for outputting a voltage regulated at a constant level receives an output of a MOS transistor 6 of a comparison amplifier for comparing a reference voltage of the reference voltage source 2 with a feedback voltage obtained by dividing a voltage output from the voltage regulator. When the voltage of the battery 1 decreases to a prescribed level where it is impossible for the power supply apparatus to output a constant voltage, the MOS transistor 23 is turned on. Simultaneously, the gate voltage of the MOS transistor 16 decreases from approximately the threshold voltage Vth to approximately zero volts.

A hysteresis buffer 20 having a hysteresis characteristic is provided to output one of two stable voltage levels in accordance with an input voltage level. The hysteresis buffer 20 includes a similar characteristic to an ordinary low voltage detection circuit. The hysteresis buffer 20 receives an output of the MOS transistor 6. The hysteresis buffer 20 switches its output from a low level to a high level when detecting and determining that the power supply voltage is lower than the prescribed power supply reference voltage.

Such a hysteresis buffer 20 forms a Schmitt trigger circuit that removes unstable oscillation of an input voltage such as oscillation appearing in the vicinity of a prescribed voltage level. The output of the MOS transistor 6, which is coupled to the gate of MOS transistor 16, is supplied to the hysteresis buffer 20, which compares it with respective threshold levels having hysteresis characteristic capable of absorbing an unstable voltage.

Specifically, the respective threshold levels are equivalent to voltage levels respectively obtained by dividing the prescribed power supply reference voltage when the power supply voltage increases and decreases. The hysteresis buffer 20 outputs one of low and high levels depending on whether the power supply voltage is lower than the power supply reference voltage.

When the power supply voltage is detected as a low level and the level changes from low to high, the MOS transistor 18 is turned off via the inverter 19. As a result a drain current hardly flows into the MOS transistor 6 of the comparison amplifier. Further, since the MOS transistors 22 and 23 are controlled in a prescribed manner, the gate voltage of the P-type MOS transistor 16 is set to the low level. Thus, the MOS transistor 16 is completely set to a turned on condition, and a power supply voltage of the battery 1 is supplied to the interior circuit 12 and external instruments.

Further, since the MOS transistor 21 is tuned on by an output from the hysteresis buffer 20 when the voltage of battery 1 decreases to the prescribed low level, a feedback resistance 24 is bypassed, and a resetting voltage allowing a low voltage mode to be reset is set higher than the low voltage level. Thus, an unstable operation of the power supply circuit owing to oscillation in the vicinity of a detection voltage can be prevented.

A modified power supply apparatus is now described with reference to FIG. 2. As shown, similar to the power supply apparatus described with reference to FIG. 1, functions of detecting a low voltage of a battery 1 and regulating a voltage are integrated in order to enable a voltage regulator to act as a low voltage detecting circuit. An output voltage of the voltage regulator is not supplied to an interior circuit 12 or external instruments when the voltage of battery 1 decreases a prescribed level.

As shown, the same signs are given to circuit parts performing the same functions to those correspondingly illustrated in FIG. 1. In the power supply apparatus illustrated by FIG. 2, current consumption in a voltage regulator is suppressed by decreasing a drain current flowing through the MOS transistor 6. Additionally, like the power supply apparatus of FIG. 1, the power supply apparatus of FIG. 2 also supports bypassing the feedback resistance 24 in the low voltage mode.

In a voltage regulator of the power supply apparatus of FIG. 2, when the voltage of battery 1 is detected as being a low voltage level, the MOS transistor 25 is turned on in order to not supply an output voltage of the voltage regulator to the interior circuit 12 or external instruments. Accordingly, the gate voltage of the P-type MOS transistor 16 is secured to the high level, and an output from the voltage regulator to the interior circuit and external instruments is controlled to be turned OFF.

When the output of the voltage regulator is turned off, in order not to precisely monitor a level of the output voltage made constant by the voltage regulator but the power supply voltage of the battery 1 itself, MOS transistors 26 and 27 are turned off and on, respectively to reroute the feedback voltage transmitted from the feedback resistances 9, 10 and

24 from the output voltage side of the voltage regulator to a power supply voltage side of the battery 1.

Numerous additional modifications and variations of the present invention are possible in light of the above teachings. It is therefore to be understood that within the scope of the appended claims, the present invention may be practiced otherwise that as specifically described herein.

The invention claimed is:

1. A power supply apparatus, comprising:

a battery configured to output a power supply voltage;

a voltage regulator having an output driver and configured to regulate the power supply voltage output from the battery and output a constant voltage to an interior circuit and external instruments through the output driver, said voltage regulator having a reference voltage source configured to provide a regulator reference voltage and a comparison use amplifier configured to compare a feedback voltage fed back from the output driver with the regulator reference voltage, an output from said comparison use amplifier being input to said output driver so that the output driver outputs the constant voltage; and a power supply voltage detecting device configured to determine if the power supply voltage of the battery is less than the regulator reference voltage based upon the output from the comparison use amplifier.

2. The power supply apparatus according to claim 1, wherein the battery power supply voltage detecting device includes:

a buffer having a hysteresis performance configured to output two stable voltage levels to the output driver in accordance with an input voltage, wherein said feedback voltage is obtained by dividing the constant voltage output from the output driver, and wherein said buffer transmits a control signal to one of an interior circuit and external instruments so as to prevent erroneous operations if the battery power supply voltage is less than the regulator reference voltage.

3. The power supply apparatus according to claim 2, wherein a bias voltage applied to the comparison use amplifier is controlled to decrease an amount of current flowing through the comparison use amplifier if the battery power supply voltage is less than the regulator reference voltage.

4. The power supply apparatus according to claim 2, wherein the constant voltage is divided by a feedback resistances and wherein a ratio between the at least two feedback resistances is changeable.

5. The power supply apparatus according to claim 2, wherein a bias voltage applied to the output driver is controlled so that the power supply voltage is directly supplied to one of the interior circuit and external instruments from the battery if the battery power supply voltage is less than the regulator reference voltage.

6. The power supply apparatus according to claim 2, wherein a bias voltage applied to the output driver is controlled to cause the output driver to output substantially the zero volts to one of the interior and external instruments if the battery power supply voltage is less than the regulator reference voltage.

7. The power supply apparatus according to claim 2, wherein the power supply voltage output from the battery is directly divided at the feedback resistance ratio and fed back to the comparison use amplifier as the feedback voltage, if the battery power supply voltage is less than the regulator reference voltage.

* * * * *